US007628112B2

(12) United States Patent
Lindskog

(10) Patent No.: US 7,628,112 B2
(45) Date of Patent: Dec. 8, 2009

(54) METHOD AND DEVICE RELATED TO A CONTAINER

(75) Inventor: Kjell Lindskog, Skelleftea (SE)

(73) Assignee: SQS Security Qube System AB, Skelleftea (SE)

( * ) Notice: Subject to any disclaimer, the term of this patent is extended or adjusted under 35 U.S.C. 154(b) by 53 days.

(21) Appl. No.: 10/503,399

(22) PCT Filed: Feb. 5, 2003

(86) PCT No.: PCT/SE03/00197

§ 371 (c)(1),
(2), (4) Date: Aug. 3, 2004

(87) PCT Pub. No.: WO03/071074

PCT Pub. Date: Aug. 28, 2003

(65) Prior Publication Data

US 2005/0139132 A1 Jun. 30, 2005

(30) Foreign Application Priority Data

Feb. 6, 2002 (SE) ..... 0200344

(51) Int. Cl.
*E05G 1/14* (2006.01)

(52) U.S. Cl. ..... 109/25; 109/29; 109/32; 109/33; 109/37

(58) Field of Classification Search ..... 109/33, 109/25–32, 34, 36–41
See application file for complete search history.

(56) References Cited

U.S. PATENT DOCUMENTS 3,559,593 A * 2/1971 Munton et al. ..... 109/25
3,779,179 A * 12/1973 Marois ..... 109/33
3,851,602 A * 12/1974 Lamping ..... 109/23
3,882,324 A * 5/1975 Smolker et al. ..... 327/525
3,990,069 A * 11/1976 Schuman ..... 340/544
4,068,780 A * 1/1978 Fegley ..... 222/5
4,273,478 A * 6/1981 Cedergren ..... 406/189
4,363,279 A * 12/1982 Johansson ..... 109/29
4,607,579 A * 8/1986 Stenild ..... 109/25
4,722,435 A * 2/1988 Mareels et al. ..... 206/1.5
4,799,435 A 1/1989 Boutroy
4,875,948 A * 10/1989 Verneker ..... 149/15
4,942,831 A * 7/1990 Tel ..... 109/29
5,072,211 A * 12/1991 Clement ..... 340/521
5,109,779 A * 5/1992 Maroist ..... 109/33

(Continued)

FOREIGN PATENT DOCUMENTS

EP 0 277 679 8/1988

(Continued)

*Primary Examiner*—Lloyd A Gall
(74) *Attorney, Agent, or Firm*—Mark P. Stone

(57) ABSTRACT

The invention pertains to a method and to an arrangement applicable to a container or to a chamber, for instance to a security chamber for valuable articles. The container/chamber(20) has a casing or shell (10) in which an explosive substance or a burstable item is housed. The arrangement has a detector (50, 50') at the shell (10) for detecting ambient temperature or shell temperature. The explosive substance is detonated or the burstable item is depressurised to prevent bursting of the outer casing/shell (10)of the container or the chamber at a predetermined temperature limit value. The detector (50, 50') for detecting the ambient temperature or the shell temperature is disposed essentially across the whole surface of the shell/casing (10).

20 Claims, 2 Drawing Sheets

U.S. PATENT DOCUMENTS

| | | | | |
|---|---|---|---|---|
| 5,289,785 | A * | 3/1994 | MacPherson et al. | 109/42 |
| 6,215,397 | B1 * | 4/2001 | Lindskog | 340/550 |
| 6,564,726 | B1 * | 5/2003 | Lindskog | 109/25 |
| 6,883,441 | B2 * | 4/2005 | Barr | 110/235 |

FOREIGN PATENT DOCUMENTS

| | | |
|---|---|---|
| GB | 1375926 | 12/1974 |

* cited by examiner

METHOD AND DEVICE RELATED TO A CONTAINER

The present invention relates to a method and to an arrangement concerning a container or a chamber, for example to a security chamber or a security container for valuable articles, wherein the container/chamber includes a casing or shell within which an explosive substance or an explosion prone item is held.

WO 93/23648 describes an example of a container that includes an alarm system and also a destructive system, which is triggered in response to an attempt to unlawfully open the container. The destructive system is intended to destroy the container contents and to render them worthless to the person or persons attempting to open the container unlawfully.

Such destructive systems often include an explosive device or an explosive substance that actively contributes to the destruction of the container contents in the case of a burglary attempt. Alternatively, the destructive system may include a pressure vessel or some other device presenting an explosion or bursting hazard. A common problem with such container-housed destructive systems is that an abnormal heating of the container can result in activation of the explosive or bursting of the container when the container shell or casing is weak. Such containers that are normally dimensioned to withstand an explosion under normal temperature conditions are no longer able to cope with explosive forces that occur in containers whose walls or casings have been heated and therewith weakened prior to the explosion. There is therefore a danger of accidents or injuries to persons in the vicinity.

The arrangement of temperature sensors in the alarmed container does not afford the necessary safety level, because local heating and local weakening of the container shell cannot be indicated reliably by such means. For example, local heating of the container can occur in a burning building or in a burning vehicle transporting the container. Local heating of the container can also be caused when trying to force the container.

A main object of the present invention is to provide a method and an arrangement, which effectively prevent explosion accidents of the aforesaid kind. This object is achieved with the method and the arrangement comprising the characteristic features set forth in the accompanying Claims.

Listed below are a number of advantages afforded by the present invention, these advantages being but a few of many advantages.

The container can be given a wall thickness and wall strength that enables the container to cope with internal blasting or explosion forces when the container wall is subjected to normal indoor and outdoor temperatures. When the container has been heated to a given limit temperature within a heated local part of the container, the destructive system is activated so that internal blasting or an internal explosion will take place whilst the container wall is still able to withstand the forces thus generated.

The container walls may be relatively thin and light in weight, which is highly beneficial when the container shall be transported between different locations, e.g. in respect of the transportation of valuable articles.

The container may be made of material that is relatively temperature-sensitive, such as a plastic material, and the anti-burglary alarm system may be designed in many different ways and made independent of the inventive temperature sensor arrangement.

According to the invention, there can be arranged a temperature sensor which senses the whole of the container exterior or the whole exterior of the shell-protected chamber.

It lies within the concept of the invention to supplement already existing containers and chambers with a temperature monitoring system.

In respect of an explosion based on the activation of a burglary alarm under normal temperature conditions, the shell of the container or said chamber will provide a satisfactory safety barrier from the aspect of personal injury. When the wall temperature of the container/chamber is heated locally to a given temperature value, for instance, there is initialised a temperature-based explosion that is activated by the inventive temperature monitoring system, wherein triggering of the explosion is calibrated so that said explosion takes place while the mechanical strength of the outer shell of the container/chamber is still sufficiently high to serve as a safety barrier.

The inventive temperature sensor arrangement can be integrated in a laminate structure, which will afford protection against forcing of the shell. Alternatively, the temperature sensor arrangement may be adhered to the exterior or the interior of a separate burglary protective shell. For example, the temperature sensor arrangement may be arranged on a plastic film or foil applied, such as glued, to a container shell or casing or to a chamber shell or casing that includes anti-burglary means of any chosen design and construction.

An existing container or an existing chamber can be readily supplemented with inventive temperature sensing mats or temperature sensor laminates.

The invention has both technical and economical advantages.

The invention will now be described in more detail by way of example and with reference to the accompanying drawings, in which FIG. 1 IS a perspective view of a container or a chamber in the form of a so-called security case;

Figure 1:
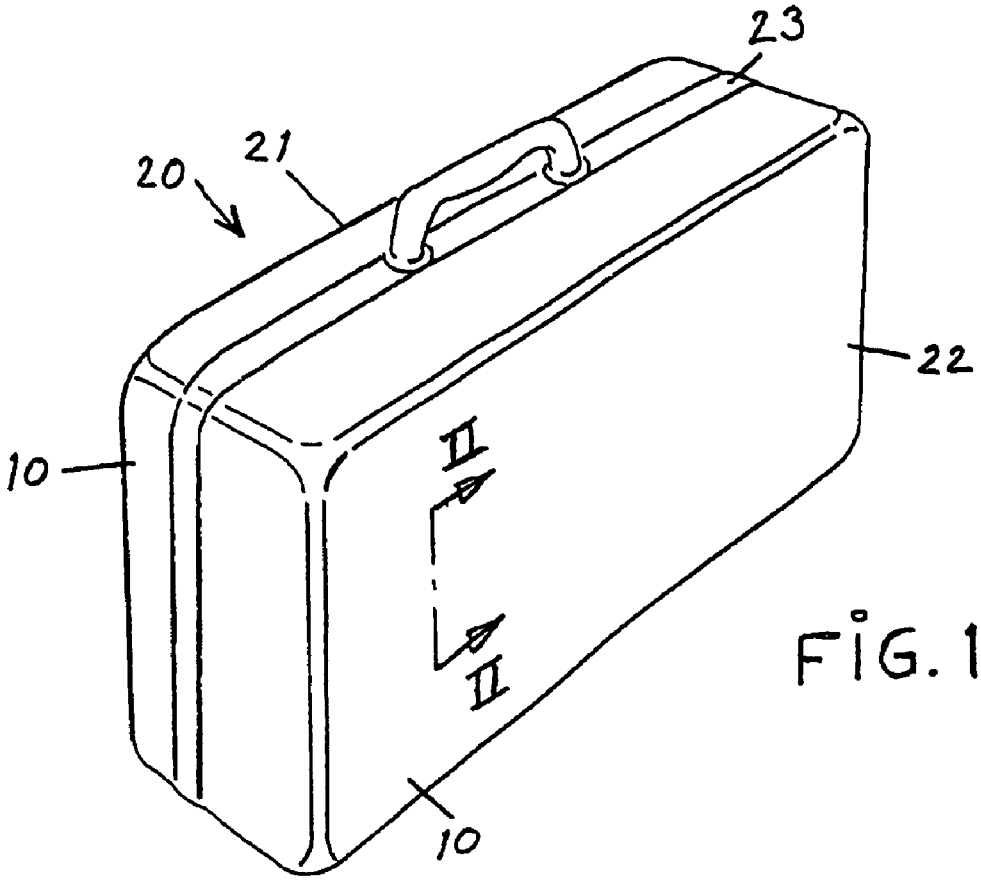

The case 20 illustrated in FIG. 1 exemplifies a container or a chamber that comprises a safety/security shell formed by a laminate structure or a sheet-like element 10. The illustrated container 20 is comprised of two parts 21,22 that have a shell-like configuration and that overlap each other in an overlap zone 23. The container/case 20 will, of course, include requisite hinges and locking means (not shown), and so on.

Figure 2:
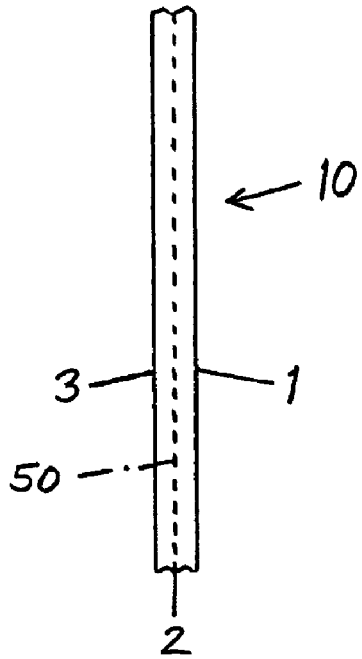
FIG. 2 is a cross-sectional view of one wall part of the container taken on the line 11-11 in FIG. 1 and shown in larger scale.
Figure 3:
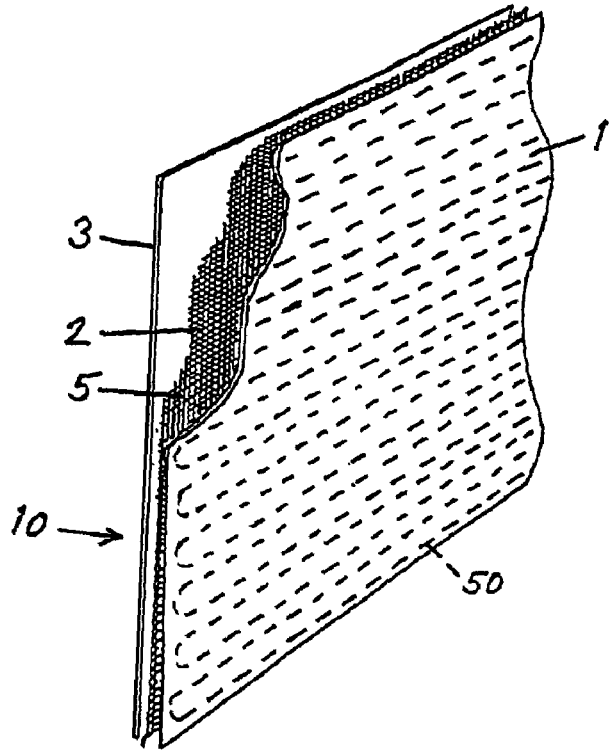
FIG. 3 is an exploded perspective view of a sheet-like element/laminate which includes an inventive temperature protection.

The shell of the case 20 is comprised of a sheet-like element 10 which includes a first outer layer 1, an alarm mat 2, and a second outer layer 3 (see FIGS. 2 and 3).

The first outer layer 1 is comprised, for instance, of fibre glass mat or a textile mat, although other types of mats, cloth or sheets can, of course, be used. The outer layer 1 may also consist of paint or a gel coating.

The alarm mat 2 is adapted to indicate or detect an attempt to force holes in the sheet element 10. The alarm sheet/alarm mat 2 may consist of a fine-mesh filament mat that has been knitted, crocheted or woven, for instance. The material used in this respect is comprised of electrically conductive filaments in the form of wire 5 or metal strips, or electrically conductive plastic material. The wire 5 may be copper wire provided with an insulating layer, such as a layer of varnish. The use of optical fibres in the alarm mat 2 is also conceivable.

The second outer layer 3 suitably has the same construction as the first outer layer 1.

In the majority of cases, the sheet-like element 10 is used so that the outer layer 1 will form the container exterior and the outer layer 3 will form the container interior, and consequently it is possible that the finish of the outer layers and their construction will vary.

The sheet-like element 10 is produced by joining together the layers 1-3, for instance by means of a gluing, injection or pressure moulding process. A number of different bonding agents may be used in this respect, such as polyester resin or other plastic resins, for instance, therewith resulting in a stable sheet-like element. Naturally, it is possible to give the sheet-like element a number of different shapes over and above the planar basic variant. For example, it is possible to produce a security container or a security bag from solely two curved laminated sections that mutually overlap in a join section. FIG. 1 illustrates an example of one such constructed transport container 20.

Arranged in the CONTAINER/CHAMBER 20 is an alarm system which, for instance, causes destruction or staining of the container contents, for instance banknotes, if an attempt is made to force a hole in the laminate or shell 10. There is used in this respect an explosive and pigment or color, wherein one function of the explosive is to improve pigment distribution and staining of said contents. The shell 10 of the container or case 20 is dimensioned to cope with the mechanical stresses and strains that occur as a result of the detonation of the explosive substance.

However, the shell 10 is weakened when exposed to abnormal heat conditions, such as in the event of a fire, wherewith there is a danger that the container casing will burst as a result of detonation of said explosive when the fire builds-up. There is therefore a danger of accidents and personal injuries occurring as a result of the explosion.

According to the present invention, such accidents are avoided by providing a temperature sensing mat 50 which covers essentially the whole of the container shell so as to indicate at an early stage even a local heating and weakening of the shell/casing.

The temperature sensing mat 50 may be integrated with the sheet-like element 10 that forms the container/chamber casing, either by being incorporated as a layer in the sheet-like element/laminate or by joining said mat to the exterior or the interior of the casing/shell 10.

The sheet-like element/laminate 10 shown in FIG. 3 includes an inventive temperature sensing mat 50, which constitutes part of the laminate and is thus integrated therewith. In the illustrated case, the temperature sensing mat 50 is located within the sheet-like element 10, although it may alternatively be applied to the outside or to the inside of said element 10. It is essential, however, that good heat communication is achieved between sheet-like element 10 and the temperature sensing mat 50. When the temperature sensing mat 50 is applied to the exterior, it will preferably be covered by an exterior covering of pigment or color, so that its thread configuration and thread orientation cannot be analysed.

Figure 4:
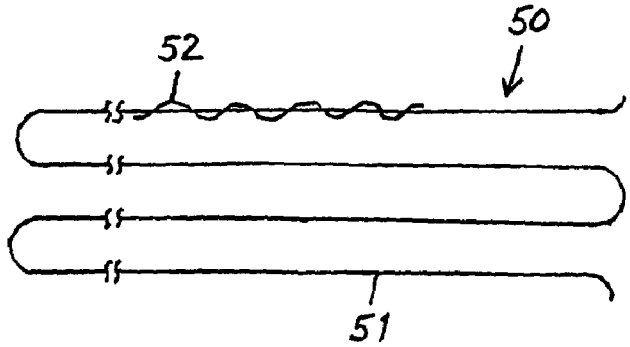
FIG. 4 is a schematic illustration of how a temperature sensing mat may be constructed.

FIG. 4 illustrates an example of one embodiment of a temperature sensing mat 50. In this case, the mat is comprised of a thread or wire 51 whose melting point corresponds to the level of temperature at which a heat alarm shall trigger the explosive substance stored in the container before the container casing has weakened to an extent at which it will burst in response to the play of forces generated by the explosion. The thread may, for instance, be comprised of tin or a tin alloy (e.g. tin solder), although, of course, other materials are conceivable. The thread material must, however, be electrically conductive since the temperature sensing mat is included in a temperature alarm circuit or in an alarm system included in the container. Should it be necessary to strengthen the alarm thread 51 mechanically, this can be achieved with a reinforcement thread 52, which is wound around the alarm thread. When necessary, the alarm thread may be electrically insulated by means of a varnish coating, for instance. As will be understood, the alarm thread 50 shown in FIG. 4 extends across the entire surface of the container shell or across the entire surface of the sheet-like elements concerned.

Figure 5:
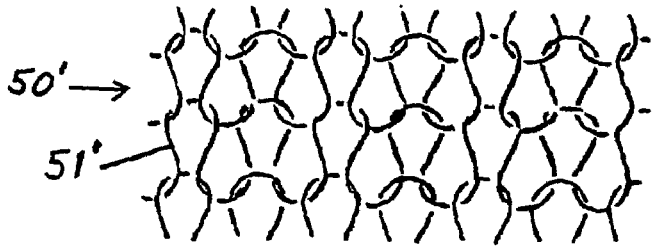
FIG. 5 IS a schematic illustration of an alternative embodiment of a temperature sensing mat.

FIG. 5 illustrates an alternative embodiment of a temperature sensing mat 50'. In this case, the temperature sensing mat is a knitted structure, wherewith the alarm thread 51 must be electrically insulated owing to the fact that threads will intersect one another. The mat covers essentially the whole of the surface of the container shell.

It will be understood that the thread, threads or strips forming the temperature sensing mat MAY, IF DESIRED, BE SUPPORTED BY, E. G., PLASTIC FILM OR FOIL OF SOME APPROPRIATE MATERIAL, SO that the mat will be easier to handle and can be joined to the shell more easily than would otherwise be the case, for instance pressed or glued thereto or adhered in some other way.

It lies within the scope of the invention to construct the temperature sensing mat in many different ways, provided that the mat will cover essentially the whole surface of the container shell. The mat may also be comprised of one or more circuits printed on film or foil.

A temperature sensing mat arranged in a container or a chamber will thus be included in an alarm system which initialises triggering of an explosive substance within the chamber before the container walls have been weakened excessively as a result of fire or abnormal heating. The threads/strips forming the mat will normally melt in response to local heating of the shell, therewith breaking the alarm circuit. Naturally, the temperature alarm may also be based on changes in the electrical resistance of the temperature sensing mat.

It will therefore be understood that may different possibilities are available in producing a refined security or safety system based on the use of inventive temperature sensing mats.

The temperature sensing mat may be used in combination with many different types of shell protectors with or without a burglary alarm in addition to the aforedescribed sheet-like elements/laminates. The case 20 described above is highly suitable for use in transporting various kinds of valuable items.

The inventive temperature sensing mats may be used, for example, in: Containers or cases for the transportation of money, security containers for transportation in vehicles and aircraft, weapon storage containers, inexpensive bank vaults, automatic telling machines, cash dispensers, etc.

It will be understood that the construction of the exemplified sheet-like element can be varied in many ways. In its simplest form, the sheet-like element can consist of only one burglary alarm layer or one temperature sensing layer and one outer layer, provided that the adhesion of the alarm mat or the temperature sensing mat to the outer layer is satisfactorily secured. If desired, additional layers of various kinds can be included in the sheet-like element per se. Variations in material selection are, of course, also possible. By way of a non-limiting example, the sheet-like element may conveniently have a thickness of about 5 mm. As will be understood, it is most often appropriate to make the sheet-like element opaque. The burglary alarm mat and/or the temperature sensing mat is suitably baked-in, moulded in or glued to said sheet-like element. The sheet-like element can be provided with reinforcements.

The inventive temperature sensing arrangement can also be used within a space that houses a spray can or some other pressurised item that is liable to explode when heated. As a result of the inventive heating indicating facility, the cans can be depressurised before the casing around the space or chamber is weakened to an extent at which the casing is liable to burst.

The inventive temperature sensing mat enables separate manufacture of a sheet-like element or a laminate adapted to detect local heating, it being possible, of course, to use such a sheet-like element in many different connections in addition to those exemplified above.

The container shell may also become brittle or become weaker with abnormal cooling of the shell, in which case there can be determined a lower limit temperature value at which detonation of the explosive in the container/chamber is initiated or the explosion-hazardous item is made safe, for instance.

In this regard, the electrically conductive elements of the temperature sensing mat must be made of a material which will enable an upper and/or a lower temperature limit to be mapped, for instance by resistance measuring, measuring the current flow or measuring luminous flow or flux or by technically equivalent measuring processes.

It is also possible to arrange one electrically conductive element for determining an upper temperature limit value and one electrically conductive element for determining a lower temperature limit value in one and the same temperature sensing mat. Alternatively, there may be used two temperature sensing mats which, if so desired, can be integrated in a laminate or sheet-like element which also forms the container casing or the chamber casing at the same time.

When necessary, the inventive temperature sensing mat may include several electric circuits/flow circuits for enhancing temperature detection precision. It will be understood that many variations and modifications are possible within the scope of the inventive concept. It is also conceivable to use optical fibres or some type of temperature sensitive light conductors.

It will also be understood that the inventive concept can be applied to containers/chambers manufactured from many different types of material, such as steel, aluminium and other metals, plastic materials, and so on.

It will therefore be understood that the invention is not restricted to the illustrated and described embodiments, since alterations and modifications of these embodiments are conceivable within the scope of the accompanying Claims.

The invention claimed is:

1. A method pertaining to a container or to a chamber, including a security chamber or a security container for valuable articles, wherein the container or chamber (20) includes an outer casing or shell (10) in which an explosive substance or a pressurized object that can explode or burst is housed, the steps of said method comprising: detecting authorized entry into said container or chamber, and permitting said detected authorized entry therein without detonating said explosive substance or depressurizing said pressurized object: detecting unauthorized entry into said container or chamber, and detonating said explosive substance or depressurizing said pressurized object upon detection of said unauthorized entry therein; detecting the ambient temperature or casing or shell temperature; causing detonation of the explosive substance or depressurization of the pressurized object upon the detection of a predetermined temperature limit value; and selecting said predetermined temperature limit value to cause detonation of the explosive substance or depressurization of the pressurized object independent of detection of authorized or unauthorized entry into said container or chamber, at a temperature at which the structural integrity of the outer casing or shell of the container or chamber is of sufficient strength to contain an explosion of the explosive substance or depressurization of the pressurized object and maintain the outer casing or shell of the container or chamber intact without bursting or fragmenting.

2. A method according to claim 1, characterised by disposing an ambient temperature or casing or shell temperature detecting means (50; 50') essentially over the entire surface of the casing or shell (10).

3. A method according to claim 1, characterised by giving an ambient temperature or casing or shell temperature detecting means (50; 50') the form of at least one thread loop (51; 51') or one tape loop or one conductor strip included in a temperature determining circuit.

4. A method according to claim 1, characterised by initializing detonation of the explosive substance or initialising reduction in the pressure of the pressurized object in response to reaching an upper temperature limit value.

5. A method according to claim 1, characterised by initialising detonation of the explosive substance or depressurizing of the pressurized object at a lower temperature limit value.

6. An arrangement for carrying out the method according to claim 1, characterised in that the casing or shell (10) includes means (50; 50') for detecting the prevailing temperature across essentially the entire outer casing or shell of the container or chamber (20).

7. An arrangement according to the claim 6, characterised in that said means for detecting the prevailing temperature includes a temperature sensing mat (50; 50') which is integrated with the casing or shell or joined to the casing or shell (10).

8. An arrangement according to claim 7, characterised in that the temperature sensing mat (50; 50') includes electrically conductive loops in the form of at least one thread loop (51,51') or one tape loop or one conductor strip; in that at least one said loop is joined to a film or a foil and is integrated with a laminate or a sheet-like element (10).

9. An arrangement according to claim 7, characterised in that the temperature sensing mat (50; 50') includes at least one light conducting loop or current conducting loop over predetermined parts of its surface.

10. A method according to claim 2, characterised by giving the ambient temperature or casing or shell temperature detecting means (50; 50') the form of at least one thread loop (51; 51') or one tape loop or one conductor strip included in a temperature determining circuit.

11. An arrangement according to claim 8, characterised in that the temperature sensing mat (50; 50') includes at least one light conducting loop or current conducting loop over predetermined parts of its surface.

12. A method according to claim 2, characterised by initialising detonation of the explosive substance or initialising reduction in the pressure of the pressurized object in response to reaching an upper temperature limit value.

13. A method according to claim 3, characterised by initialising detonation of the explosive substance or initialising reduction in the pressure of the pressurized object in response to reaching an upper temperature limit value.

14. A method according to claim 10, characterised by initialising detonation of the explosive substance or initialising reduction in the pressure of the pressurized object in response to reaching an upper temperature limit value.

15. A method according to claim 2, characterised by initialising detonation of the explosive substance or depressurizing of the pressurized object at a lower temperature limit value.

16. A method according to claim 3, characterised by initialising detonation of the explosive substance or depressurizing of the pressurized object at a lower temperature limit value.

17. A method according to claim 10, characterised by initialising detonation of the explosive substance or depressurizing of the pressurized object at a lower temperature limit value.

18. An arrangement for carrying Out the method according to claim 2, characterised in that the casing or shell (10) includes means (50; 50') for detecting the prevailing temperature across essentially the entire outer casing or shell of the container or chamber (20).

19. An arrangement for carrying out the method according to claim 3, characterised in that the casing or shell (10) includes means (50; 50') for detecting the prevailing temperature across essentially the entire outer casing or shell of the container or chamber (20).

20. An arrangement for carrying out the method according to claim 10, characterised in that the casing or shell (10) includes means (50; 50') for detecting the prevailing temperature across essentially the entire outer casing or shell of the container or chamber (20).

* * * * *